United States Patent [19]

Hayes

[11] Patent Number: 4,579,241

[45] Date of Patent: Apr. 1, 1986

[54] TAMPER EVIDENT PLASTIC CLOSURE

[75] Inventor: Thomas H. Hayes, Lancaster, Ohio

[73] Assignee: Anchor Hocking Corporation, Lancaster, Ohio

[21] Appl. No.: 676,497

[22] Filed: Nov. 29, 1984

[51] Int. Cl.[4] ..... B65D 41/34

[52] U.S. Cl. ..... 215/252

[58] Field of Search ..... 215/252, 258

[56] References Cited

U.S. PATENT DOCUMENTS 4,299,328 11/1981 Ochs et al. ..... 215/252

4,501,373 2/1985 Heinlein ..... 215/252

4,503,985 3/1985 Swartzbaugh et al. ..... 215/252

4,506,795 3/1985 Herr ..... 215/252

*Primary Examiner*—Donald F. Norton

*Attorney, Agent, or Firm*—Stoll, Wilkie, Previto and Hoffman

[57] ABSTRACT

A molded plastic closure cap has a lower skirt portion which is defined by a 360° serpentine cut and which is forced downwardly and clear of the closure during cap removal or loosening for clearly indicating that the package has been opened or tampered with.

8 Claims, 15 Drawing Figures

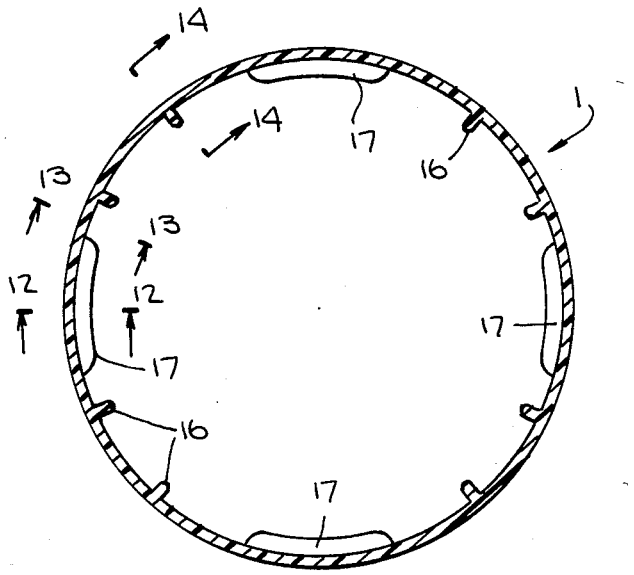
Fig. 10
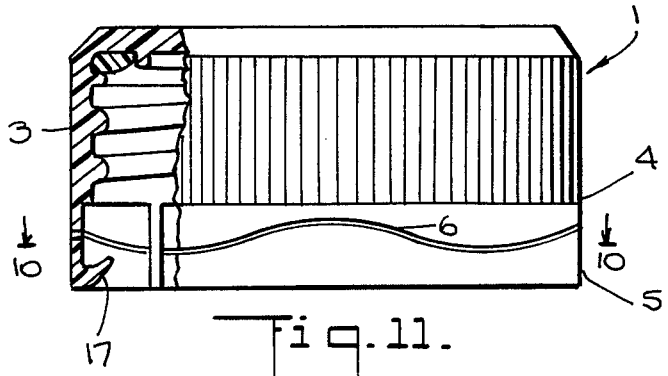
Fig. 11.
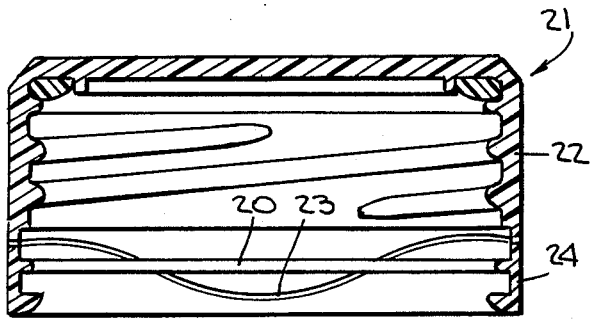
Fig. 15.
Fig. 12.
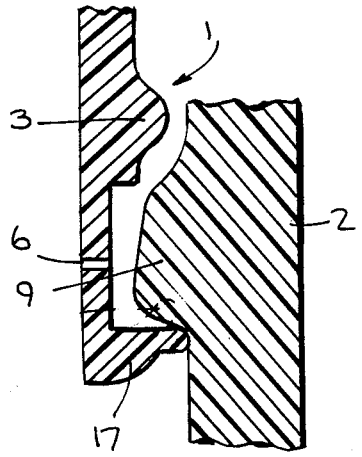
Fig. 13.
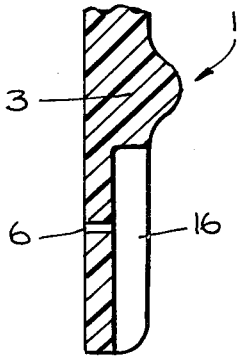
Fig. 14.
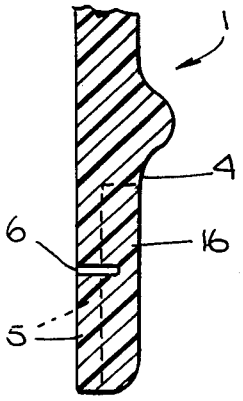

TAMPER EVIDENT PLASTIC CLOSURE

BACKGROUND OF THE INVENTION

The present invention relates to a molded plastic closure cap having a cap top and skirt with container engaging means on the cap skirt where a lower portion of the skirt or band is visibly separated from the remaining portion of a cap skirt on cap removal or partial removal. This general type of closure cap is used on products where there may be product damage due to cap removal and where possible damage to the packaged product is indicated by the separation of the tamper indicating band.

The closure of the present invention is a molded plastic closure cap having the usual cap cover and having a novel depending skirt with a container sealing gasket positioned on the cap cover or upper skirt.

There have been a number of prior caps having tamper indicating bands which have been rolled or otherwise locked to a container bead. In addition there have been closures where a relatively slight indication has been provided for cap removals by the detachment of a tamper indicating band.

The object of the present invention is to provide an improved tamper evident molded closure having a clear indication and which is easily applied to the container.

Another object of the present invention is to provide a molded plastic tamper evident closure having an irregular serpentine parting line provided on the cap skirt.

Another object of the present invention is to provide an easily applied and reapplied tamper evident closure.

Other and further objects of the present invention will become apparent upon an understanding of the illustrative embodiments about to be described, or will be indicated in the appended claims and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 11 is a side elevational view partially cut away of a further embodiment of the closure cap in accordance with the invention.

FIG. 10 is a horizontal sectional view taken along line 11—11 on FIG. 11.

FIGS. 12 thru 14 are vertical sectional views taken along lines 12—12, 13—13 and 14—14 on FIG. 11.

FIG. 15 is a vertical sectional view of another embodiment of the closure cap in accordance with the invention.

DESCRIPTION OF THE PREFERRED EMBODIMENT

Figure 1:
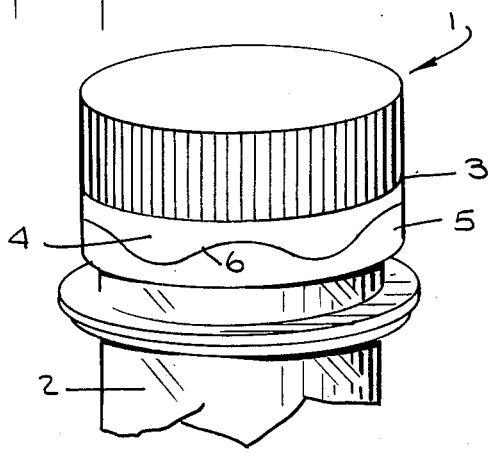
FIG. 1 is a perspective view illustrating a package sealed with a closure in accordance with the invention.

FIG. 1 illustrates a closure cap 1 sealing a container 2 with the top portion 4 of the cap skirt 3 and the tamper indicating band portion 5 combining to form a smooth cylindrical skirt 3 showing that the closure cap 1 has not been loosened or removed from the container 2.

Figure 2:
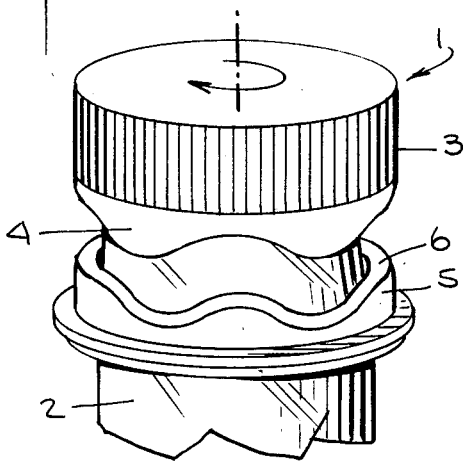
FIG. 2 is a perspective view illustrating the closure of FIG. 1 partially removed from the package.

FIG. 2 illustrates the closure cap 1 loosened or partially removed from the container 2 so that the tamper indicating band 5 defined by the wavy cut line 6 has been forced downwardly and clear of the remaining top portion 4 of the skirt 3 giving a clear indication that the cap 1 has been at least partially removed or loosened on the container 2.

The closure cap 1 illustrated in FIGS. 1 and 2 includes means for resisting a rotation of the tamper indicating band 5 with respect to the container 2 during the removal of the cap 1. This causes relative rotation between the top portion 4 of the skirt 3 and the tamper indicating band 5. The relative rotation causes the lowermost portions of the skirt portion 4 to force or cam the uppermost portions of the skirt portion 4 to force or cam the uppermost portions of the tamper indicating band 5 downwardly to snap or force the band 5 clear of the cap 1 as illustrated in FIG. 2.

Figure 3:
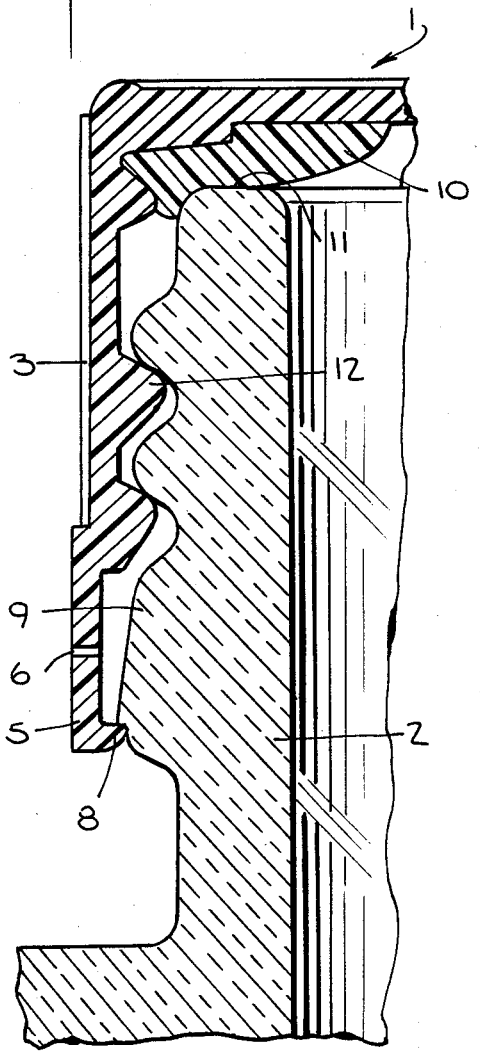
FIGS. 3 and 4 are vertical sectional views of one embodiment of the closure of the invention in the sealed and partially opened positions respectively.
Figure 4:
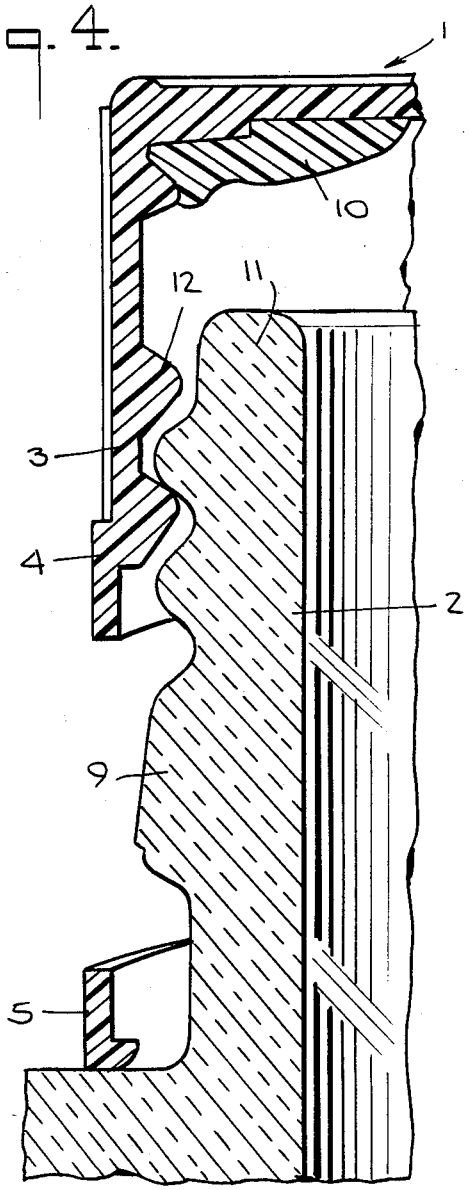
Figure 6:
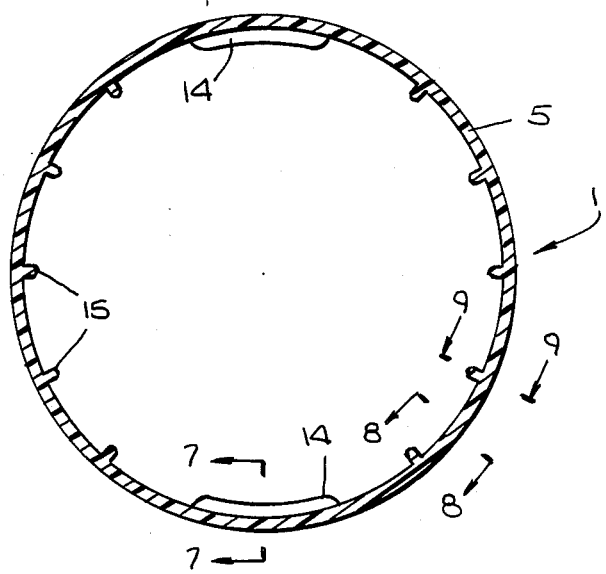
FIG. 6 is a sectional view taken along line 6—6 on FIG. 5.

FIGS. 3 and 4 illustrate one embodiment of the invention where the closure cap 1 has means for holding the tamper indicating band 5 against rotation during cap removal comprising a frictional engagement between a lip 8 on the bottom of the band 5 and a transfer bead 9 on the container 2. This frictional engagement provides for the relative rotation described above.

In FIG. 3 the container 2 is illustrated in its sealed condition with a gasket 10 in sealing engagement with the rim 11 of the container 2. In FIG. 4 the cap 1 has been turned partially off of the container 2, so that the tamper indicating band 5 has been loosened and forced downwardly even though the container 2 may not have been fully opened. Thus, the tamper indication is obtained both for a fully opened container or for the case where the closure 1 has been only partially turned with the seal broken but with the cap 1 still remaining on the container 2. In the embodiment illustrated in FIGS. 3 and 4 the cut-line 6 extends completely through the skirt 3 and it is formed after the cap 1 has been applied to the container 2 by suitable cutting means. The relative positions of the cap container engaging threads 12 and the frictional grip of the lip 8 maintain tamper indicating band 5 in the sealed position as illustrated in FIGS. 1 and 3. During the initial sealing, the cap 1 need only be turned onto the container and the cut 6 made.

Figure 5:
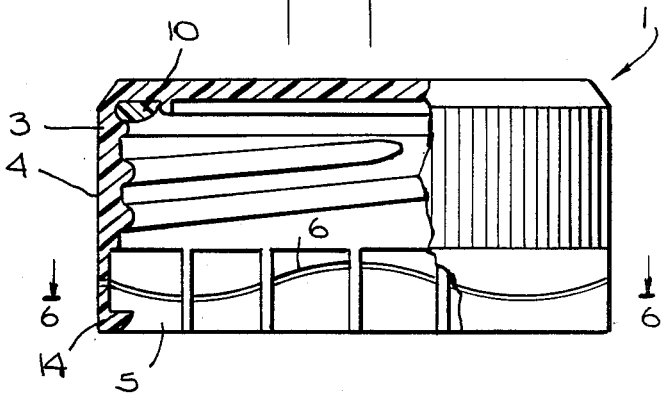
FIG. 5 is a side elevational view, partially cut away, illustrating another embodiment of the closure employing connecting bridges and having a strapping action.
Figure 7:
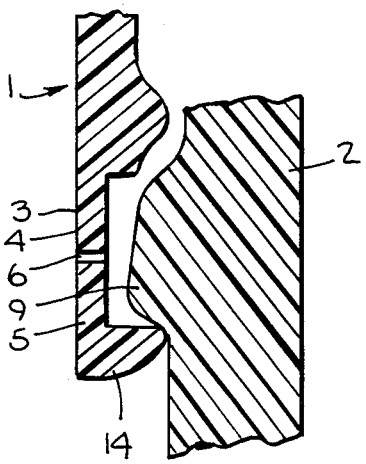
FIGS. 7 thru 9 are vertical sectional views taken along lines 7—7, 8—8 and 9—9 on FIG. 6.
Figure 9:
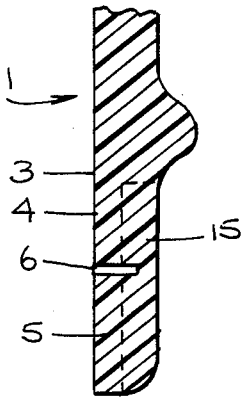

FIGS. 5 and 9 illustrate another embodiment of the closure cap 1 which uses a similar cut line 6 defining the tamper indicating band 5 on the lower portion of the cap skirt 3. In this embodiment the engagement between the tamper indicating band 5 and the container 2 is provided by a pair of spaced strapping locks 14 which engage the transfer bead 9 on the container 2 as illustrated in FIG. 7.

A number of connecting bridges 15 are molded on the cap skirt 3 which extend downwardly over the inner surface of the cap skirt 3 on either side of the cut line 6. These bridges 15 keep the tamper indicating band 5 in place on the sealed container 2. The cut line 6 may be formed before or after the sealing and as illustrated in the sectional FIGS. 7 thru 9, the line 6 extends completely through the lower portion of the cap skirt at all portions except at the connecting bridges where, as illustrated in FIG. 9, the line 6 extends only partially through the bridges 15. When the cap 1 is turned on the container 2, the strapping locks 14 hold the indicating band portion 5 of the skirt 3 against rotation snapping the bridges 15 and resulting in the downward caming action already described in connection with the description of FIGS. 1 and 2. This forces the tamper indicating band 5 downwardly well clear of the remaining portion 4 of the cap skirt 3 to indicate that the cap 1 has been loosened or previously removed. Preferably, a pair of strapping locks are used in order to obtain the strapping or gripping action for the tamper indicating band 5 as the diametrically spaced locks 14 hold the band 5 downwardly causing intermediate portions of the band 5 to be pulled inwardly in gripping relationship with the container bead 9. This is the same strapping action described in U.S. Pat. No. 4,299,328 for a differing style of tamper indicating closure. The strapping action aids in the initial separation of the band 5 from the remainder of the skirt 3 but is overcome as the cap moves upwardly and the above described positive caming action occurs, causing the separated band 5 to be forced downwardly on the container 2 and away from the remaining portion 4 of the closure cap 1. Additionally the strapping action permits the band to be oversized to prevent bridge breakage during application while having a positive removal because of the ovalization.

FIGS. 10 thru 14 illustrate another embodiment in which generally equally spaced bridges 16 are formed on the skirt 3 to maintain the tamper indicating band 5 in position on the cap 1 during the initial sealing as illustrated in FIG. 1. The closure cap 1 has a number of generally equally spaced locks 17 which engage the transfer bead 9 on the container 2 to hold the band 5 down upon cap removal causing the bridges 16 to break and the band 5 to be forced clear of skirt 3 portion 4.

Figure 8:
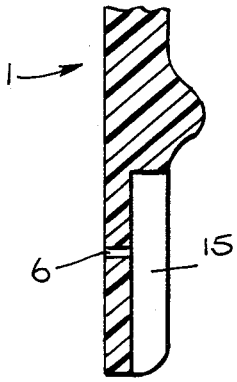

While FIGS. 8 and 10 illustrate the bridges 15 and 16 on the inside of the skirts, the bridges may be positioned on the outside of the skirt with the band being the radially innermost portion of the skirt.

FIGS. 12 and 13 are sectional views of the closure skirt of the closure cap 1 taken along the sectional lines indicated on FIG. 10.

FIG. 15 illustrates another embodiment of the closure cap where the bridges or friction action are replaced by a horizontal bead 20 extending around the inner surface of the cap 21 skirt 22 so that it crosses a wavy cut line 23. The line 23 may be cut before or after the closure cap 21 is applied to a container. The line 23 is cut fully through the cap skirt 22 but does not cut the bead 20 so that the bead 20 acts as a temporary connector for the band 24 which is broken to release the tamper indicating band 24 during cap removal.

It will be seen that an improved molded tamper indicating cap is disclosed which combines ease of manufacture and application with a positive tamper indicating action.

As various changes may be made in the form, construction and arrangement of the invention and without departing from the spirit and scope of the invention, and without sacrificing any of its advantages, it is to be understood that all matter herein is to be interpreted as illustrative and not in a limiting sense.

Having thus described my invention, I claim:

1. An improved molded tamper evident plastic closure cap for sealing a container comprising the combination of:

a cap shell having a cap cover and a depending skirt;

first means on said depending skirt for removably engaging the container;

second means positioned adjacent the lower edge of the depending skirt for engaging the container for resisting a movement of the cap skirt on the container;

an irregularly shaped line of weakness encircling said cap skirt above said second engaging means defining a tamper indicating band; and a generally horizontal bead extending inwardly from the interior skirt surface and intersecting said irregularly shaped line of weakness at a plurality of locations.

2. The closure cap as claimed in claim 1 in which the line of weakness is serpentine.

3. The closure cap as claimed in claim 1 in which the line of weakness comprises irregularly aligned camming sections.

4. The closure cap as claimed in claim 1 in which said second engaging means comprises a frictional engagement.

5. The closure cap as claimed in claim 4 in which said second engaging means comprises a lip means projecting inwardly from the inner surface of said closure cap skirt.

6. The closure cap as claimed in claim 1 in which said second engaging means comprises a plurality of spaced locks on the lower edge of said skirt.

7. The closure cap as claimed in claim 6 in which there are a pair of diametrically spaced locks for providing a strapping action.

8. The closure cap as claimed in claim 6 in which there are four or more equally spaced locks.

* * * * *